United States Patent [19]

Rosenkilde

[11] Patent Number: 4,501,097

[45] Date of Patent: Feb. 26, 1985

[54] RIDGE ELEMENT FOR CORRUGATED ROOFS

[76] Inventor: Johannes Rosenkilde, Gröddevej 12, Ikast, Denmark

[21] Appl. No.: 395,042

[22] PCT Filed: Oct. 20, 1981

[86] PCT No.: PCT/DK81/00090

§ 371 Date: Jun. 21, 1982

§ 102(e) Date: Jun. 21, 1982

[30] Foreign Application Priority Data

Oct. 21, 1980 [DK] Denmark ..... 4444/80

[51] Int. Cl.[3] ..... E04D 1/36

[52] U.S. Cl. ..... 52/57; 52/277; 52/537

[58] Field of Search ..... 52/277, 278, 553, 276, 52/537, 519, 520, 90, 57, 43, 273, 285, 718, 732, 63

[56] References Cited

U.S. PATENT DOCUMENTS

| | | | |
|---|---|---|---|
| 317,868 | 5/1885 | Smith | 52/277 |
| 540,913 | 6/1885 | Hille | 52/520 |
| 982,916 | 1/1911 | Williams et al. | 52/277 |
| 1,195,643 | 8/1916 | Baumgartt | 52/57 |
| 1,405,966 | 2/1922 | Burnett | 52/278 |
| 1,677,031 | 7/1928 | Kuehn | 52/277 |
| 2,021,929 | 11/1935 | Voigt | 52/277 |
| 4,024,685 | 5/1977 | Aarons | 52/278 |
| 4,270,330 | 6/1981 | Townsend | 52/90 |
| 4,307,553 | 12/1981 | Puckett | 52/520 |

FOREIGN PATENT DOCUMENTS

| | | | |
|---|---|---|---|
| 1265384 | 4/1968 | Fed. Rep. of Germany | 52/57 |
| 2219233 | 10/1973 | Fed. Rep. of Germany . | |
| 2339832 | 2/1975 | Fed. Rep. of Germany . | |
| 2653053 | 9/1977 | Fed. Rep. of Germany . | |
| 7802 | of 1912 | United Kingdom | 52/276 |

*Primary Examiner*—John E. Murtagh
*Assistant Examiner*—Andrew Joseph Rudy
*Attorney, Agent, or Firm*—Antonelli, Terry & Wands

[57] ABSTRACT

A ridge element for corrugated roofs is made as a monolithic tile member (2) having an upper arched shell portion (4), the underside of which is provided with protrusions (8) showing exterior edges (10) profiled so as to be engageable with the corrugations of the opposed roofing elements (12) when these form a specific ridgeangle with each other. The same or similar ridge elements will be advantageously usable for other ridge angles, too, because a relative tilting of the roofing elements will produce small gaps only between the surface thereof and the non-engaged portions of the tile edges (10), whereby a complete sealing will require relatively small amounts of sealing compound. In practice, therefore, one type of ridge tile will be usable for all relevant ridge angles, Preferably the tile edges are provided with compressible sealing strips which will normally obviate any additional use of sealing compound, whereby the tiles are very easy to mount.

6 Claims, 4 Drawing Figures

RIDGE ELEMENT FOR CORRUGATED ROOFS

Figure 1:
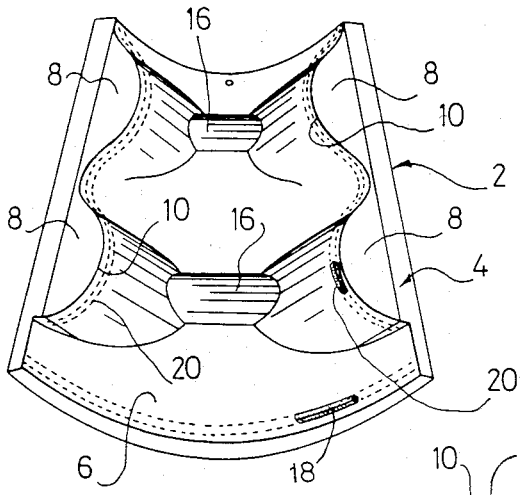

The present invention relates to a ridge element for corrugated roofings for bridging the top gap between opposed inclined roof portions forming with each other an angle of any size between 50° and 160°, with the ridge element having opposed wing portions profiled so as to generally be engageable with the standard corrugations of the roofing.

As described in several publications, e.g. DE-OS No. 26 53 053, the use of corrugated roofings have presented certain problems as far as the ridge elements are concerned, specifically due to the fact that roofs are not built with any standard roof angle, whereby an ideal ridge element should be produced in as many types as corresponding to the number of different roof angles used in practice, this of course being highly inconvenient. The previous development of the ridge elements historically ranges from simple ridge tiles rested to angularly adjustable ridge elements having a top hinge and wing portions profiled so as to correspond to the corrugation of the roofing elements, whereby these ridge elements could be easily adjusted to the actual roof angle and nevertheless engage the corrugations of the roofing in a desired tight manner. These ridge elements were produceable in conventional roofing plate materials such as asbestos cement, but the top hinge contributed to a relatively high price of the products. According to a following development the ridge elements were suggested to be made from a flexible artificial material, whereby the corrugated wings of the elements could be laid tightly against the upper portions of the correspondingly corrugated roofing elements irrespective of the roof angle because these ridge elements show a bendable uppermost middle portion. This could seem to be an ideal solution, but the bendable ridge elements are rather expensive, and they require an extra mounting work because they should be secured to the roof at both sides of the very ridge of the roof in order to provide for the desired tight engagement between the roofing elements and the corrugated wing portions of the ridge elements.

In practice one of the most widely used ridge elements is the first mentioned simple tile shell, which is laid onto the roof ridge, whereafter the openings between the lower edges of the element and the top side of the corrugated roofing plates or tiles are cemented or filled out with another suitable filler means or compound, often an expensive sealing compound.

It is the purpose of the invention to provide an improved ridge element which is easy to produce and handle and is usable for a wide variety of roof angles.

The ridge element according to the invention is a rigid monolitic member, the opposed wing portions of which having along their outer longitudinal edges respective downwardly projecting flange portions, the lower edges of which are shaped to accomodate, in use, the standard corrugation of the roofing when the ridge angle is an angle between 90°–140°.

The invention is based on the recognition that a flange portion having a free narrow edge shaped so as to generally follow or contact the top surface of a corrugated roofing element, when the flange portion extends crosswise of the corrugations, will still, to at least a high degree, follow the corrugated surface when the angle of incidence of the flange portion relative the roofing element is changed somewhat. Therefore, when a ridge element or tile according to the invention is mounted generally horizontally on the ridge of the roof, i.e. with the flange portions rested against the roofing elements and assuming a standard inclination, then the lower edges of the flange portions will follow the roof element corrugations entirely or at least relatively closely irrespective of the roof angle, of course within reasonable limits. When the ridge angle is so small, e.g. 60°, or so large, e.g. 135°, that the ridge element does not entirely fill out or follow the corrugations, then these will at least be filled out to such a degree that a complete sealing is obtainable with the use of very small amounts of filler material.

Besides, the ridge element or tile can be premounted with a compressible sealing strip along each of the edges of the flange portions or the protrusions. Practice has shown that with this simple measure one standard tile type is usable for practically the full range of ridge angles, without any need of additional use of sealing compound, even when the thickness of the sealing strip is less than a centimeter.

The ridge tile according to the invention is easy to produce as a cast concrete member. It should of course be shaped in accordance with the corrugation pattern of the relevant roofing, whether symmetric as in most large roofing panels or asymmetric as in connection with usual roof tiles.

Figure 2:
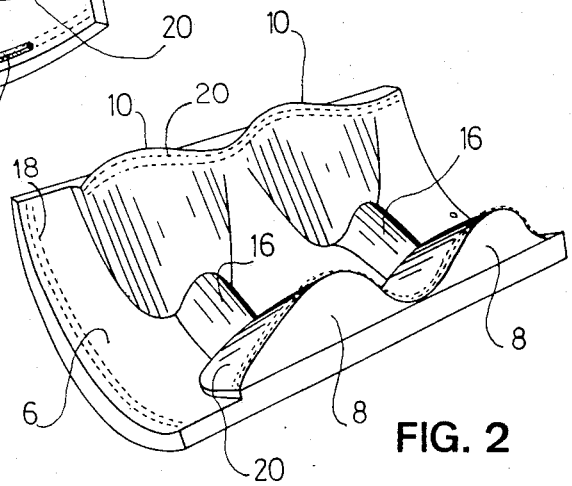
Figure 3:
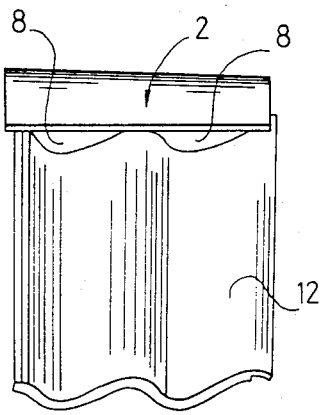
Figure 4:
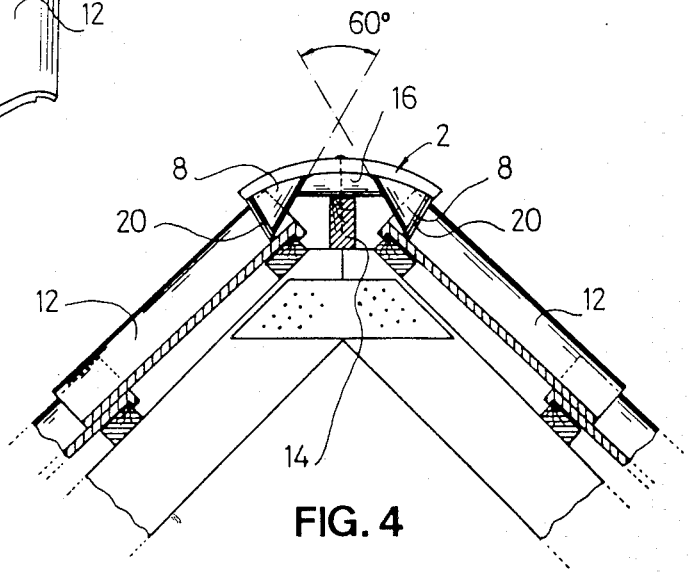

In the following the invention is described in more detail with reference to the drawing, in which:

FIG. 1 is a perspective view of a first type of a ridge tile according to the invention, seen upside down, FIG. 2 is a corresponding view of another type of the tile, FIG. 3 is a side view of the latter as mounted on a tile covered roof, and FIG. 4 is a sectional view of a roof construction including a ridge tile according to the invention.

The ridge tile generally designated by the reference numeral 2 shown in FIG. 1 comprises an arched shell portion generally designated by the reference numeral 4 having on its concave underside 6 two opposed rows of protrusions 8 shaped as inclined cylindrical portions forming at each side or wing of the tile a corrugated surface having an outer edge 10 along the outer end wall of the protrusions 8, with these end walls forming at each side an inclined side wall of the tile 2. On the central portion of the underside 6 is arranged a pair of transverse reinforcing ribs 16, which, like the protrusions 8, are cast in one piece with the remaining tile element.

The corrugated surfaces as formed by the protrusions 8 are of a symmetrical regular shape, while the tile shown in FIG. 2 is provided with corresponding protrusions shaped in a non-symmetrical manner for cooperation with complementarily non-symmetrical corrugations of ordinary roof tiles. In FIG. 3 is shown such a ridge tile 2 as laid on a roofing represented by one roof tile 12.

FIG. 4 is representative of the practical mounting of a tile according to both FIGS. 1 and 2. The roof construction shown comprises roofing elements designated 12 as in FIG. 3 and a central ridge board 14. The ridge tile 2 is laid onto the ridge of the roof such that the edge portions 10 of the protrusions 8 engage with the top side of the corrugated roofing elements 12. The height of the ridge board 14 is so adjusted that the top side thereof will be located in level with or closely underneath the lowermost portions of the transverse ribs 16 of the ridge tiles, when the edge portions 10 engage the roofing elements 12, and the board 14 may hereby serve to further support the ridge tiles 2 and/or as an anchoring means for the ridge tiles 2, which may be secured simply by being nailed to the top side of the board 14. The ridge tiles 2 are slightly converging so as to be able to overlap each other when laid in a row along the ridge.

In the example shown in FIG. 4 the generators of the opposed cylindrical protrusions 8 form an angle of 60° with each other, this angle corresponding to the smallest expected ridge angle of a relevant roof construction. Thus, when the ridge angle is 60° or more, the outer edges 10 of the protrusions 8 will engage the corrugated top surface of the roofing elements 12, though not necessarily touching the corrugated surface all along the edge 10, but, for example, only along the top portions or the bottom portions of the edge 10.

The shape of the edge 10 as determined by the cross sectional shape of the protrusions 8 and the angle between the generators and the outer end surfaces of the protrusions 8 may be chosen so as to correspond to an overall engagement between the edge 10 and the corrugated roofing elements when the ridge angle shows a certain normal value, e.g. 110° or, preferably, a value somewhere between 90° and 140°. If the actual ridge angle is smaller or larger than this value, then the edge 10 will ride on the top portions of the corrugated roofing surface while at the bottom of the corrugations the edge 10 will be spaced from the roofing surface the more the deviation is between the said normal value and the actual value of the ridge angle. However, even for relatively high angular deviations from the normal value the spacing will be considerably smaller than the height of the corrugations themselves, and the corresponding free gaps between the edge 10 and the bottom portions of the corrugations may therefore be filled out with some sealing compound used in relatively small amounts.

Another possibility will be to use a shape of the edges 10 corresponding to full engagement between these edges and the roofing corrugations when the ridge angle has a value corresponding to both the maximum and the minimum value of the expected total ridge angle range, whereby a maximum gap between the edge 10 and the roofing corrugations will occur when the actual ridge angle is half the differential angle between said maximum and minimum. In this case the gaps will occur adjacent the top portions of the roofing corrugations, because the edges 10 will be primarily rested on the bottom portions of the corrugations. The maximum gap will occur when the actual ridge angle corresponds to the above mentioned normal ridge angle.

In practice it may be preferred to select the shape or contour of the edges 10 in such a manner that an overall engagement between these edges and the roofing corrugations is obtained when the actual ridge angle is either or rather both somewhat more or somewhat less than the normal value, whereby the actual gaps to be filled with a suitable sealing compound will be minimized generally.

However, it is an important aspect of the invention that the size of the gaps as occuring for one or more ridge angle ranges will normally be rather small anyway and that, therefore, a very good sealing of the gaps is obtainable when a resilient or compressible sealing strip, e.g. of sponge rubber, is placed between the edge 10 and the roofing. In practice such a strip need not have a thickness of more than 5–10 mm, and with the use of the strip the overall sealing will be improved, such that the entire system may show rather coarse tolerances.

With the use of sealing strips backed by an adhesive the strips may easily be premounted on the ridge tiles, and in FIG. 1 is shown a sealing strip 18 on the overlapping portion of the ridge tile and a strip 20 on each of the two corrugated edges 10.

The angular positions of the outer end surfaces of the protrusions 8 are unimportant for the desired effect of the ridge tiles, but preferably these surfaces are sloping downwardly and inwardly as shown in FIG. 4.

When sealing strips are premounted on the edges 10 these strips will affect the relative dimensions of the corrugated edges, and this should be taken into account when the shape of the edge 10 of the tile member itself is designed for the tile production in order to make the strip fitted tile tightly engageable with roof elements showing the "normal" ridge angle.

I claim:

1. A ridge element for corrugated roofings bridging a top gap between opposed inclined roof portions, said ridge element having a substantially smooth arched shell portion having on a concave underside opposed wing portions profiled so as to be generally engageable with standard corrugations of the roofing, characterized in that the ridge element is a rigid monolithic member, the opposed wing portions are provided along respective outer longitudinal edges with downwardly projecting flange portions, lower edges of said projecting flange portions are shaped to accommodate, in use, a standard corrugation of the roofing when a ridge angle is between 90° and 140°, said flange portions are constituted by outer end portions of partly cylindrical protrusions on the underside of the ridge element, a generator direction of the protrusions of the opposed wing portions forming an angle with each other which is between 45° and 90°.

2. A ridge element according to claim 1, characterized in that the outer end surfaces of said protrusions are located in a plane which is downwardly and inwardly inclined.

3. A ridge element according to claim 1 or 2, characterized in that the element is shaped generally as a curved plate member (4) having a smooth top side and a convex underside, from which the protrusions project, the plate member having at one end a projection free underside portion adapted to cover the top side of the opposite end portion of a neighboring ridge element.

4. A ridge element according to claim 3, characterized in that the central portion of the underside of the element is shaped with transversely extending reinforcing and supporting ribs.

5. A ridge element according to claim 2, characterized in that the said flange portions or protrusions are profiled in a non-symmetrical manner so as to accomodate the profilation of nonsymmetrically profiled roof tiles.

6. A ridge element according to claim 2, characterized in that a compressible sealing strip member is provided along the edges of the flange portions or the protrusions.

* * * * *